US011414720B2

(12) United States Patent
Hasegawa et al.

(10) Patent No.: US 11,414,720 B2
(45) Date of Patent: Aug. 16, 2022

(54) HIGH-STRENGTH STEEL SHEET FOR WARM WORKING AND METHOD FOR MANUFACTURING THE SAME

(71) Applicant: JFE STEEL CORPORATION, Tokyo (JP)

(72) Inventors: Hiroshi Hasegawa, Tokyo (JP); Yoshimasa Funakawa, Tokyo (JP)

(73) Assignee: JFE STEEL CORPORATION, Tokyo (JP)

( * ) Notice: Subject to any disclaimer, the term of this patent is extended or adjusted under 35 U.S.C. 154(b) by 1028 days.

(21) Appl. No.: 16/073,905

(22) PCT Filed: Jan. 26, 2017

(86) PCT No.: PCT/JP2017/002614

§ 371 (c)(1),
(2) Date: Jul. 30, 2018

(87) PCT Pub. No.: WO2017/131053

PCT Pub. Date: Aug. 3, 2017

(65) Prior Publication Data

US 2019/0040489 A1 Feb. 7, 2019

(30) Foreign Application Priority Data

Jan. 29, 2016 (JP) ..... JP2016-016097

(51) Int. Cl.

| | |
|---|---|
| ***C21D 9/46*** | (2006.01) |
| ***C22C 38/14*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/08*** | (2006.01) |
| ***C22C 38/12*** | (2006.01) |
| ***C22C 38/16*** | (2006.01) |
| ***C22C 38/24*** | (2006.01) |
| ***C22C 38/28*** | (2006.01) |
| ***C22C 38/38*** | (2006.01) |
| ***C21D 6/00*** | (2006.01) |
| ***C21D 8/02*** | (2006.01) |
| ***C23C 2/06*** | (2006.01) |
| ***C23C 2/40*** | (2006.01) |
| ***C23C 2/02*** | (2006.01) |
| ***C23C 2/28*** | (2006.01) |
| ***C22C 38/60*** | (2006.01) |
| ***C23C 2/26*** | (2006.01) |
| ***C23F 17/00*** | (2006.01) |

(52) U.S. Cl.

CPC ..... *C21D 9/46* (2013.01); *C21D 6/001* (2013.01); *C21D 6/002* (2013.01); *C21D 6/005* (2013.01); *C21D 6/008* (2013.01); *C21D 8/0205* (2013.01); *C21D 8/0226* (2013.01); *C21D 8/0231* (2013.01); *C21D 8/0236* (2013.01); *C21D 8/0263* (2013.01); *C21D 8/0278* (2013.01); *C22C 38/00* (2013.01); *C22C 38/001* (2013.01); *C22C 38/002* (2013.01); *C22C 38/005* (2013.01); *C22C 38/008* (2013.01); *C22C 38/02* (2013.01); *C22C 38/04* (2013.01); *C22C 38/06* (2013.01); *C22C 38/08* (2013.01); *C22C 38/12* (2013.01); *C22C 38/14* (2013.01); *C22C 38/16* (2013.01); *C22C 38/24* (2013.01); *C22C 38/28* (2013.01); *C22C 38/38* (2013.01); *C22C 38/60* (2013.01); *C23C 2/02* (2013.01); *C23C 2/06* (2013.01); *C23C 2/26* (2013.01); *C23C 2/28* (2013.01); *C23C 2/40* (2013.01); *C23F 17/00* (2013.01); *C21D 2211/001* (2013.01); *C21D 2211/002* (2013.01); *C21D 2211/005* (2013.01); *C21D 2211/008* (2013.01)

(58) Field of Classification Search

CPC ..... C22D 9/46

See application file for complete search history.

(56) References Cited

U.S. PATENT DOCUMENTS

| | | | | |
|---|---|---|---|---|
| 10,370,737 | B2 * | 8/2019 | Hasegawa | C22C 38/24 |
| 10,450,642 | B2 * | 10/2019 | Hasegawa | B32B 15/013 |
| 11,248,275 | B2 * | 2/2022 | Hasegawa | C22C 38/04 |
| 2013/0037180 | A1 | 2/2013 | Sano et al. | |
| 2014/0000765 | A1 | 1/2014 | Nozaki et al. | |
| 2014/0050941 | A1 * | 2/2014 | Kawasaki | B32B 15/012 428/653 |

(Continued)

FOREIGN PATENT DOCUMENTS

| | | |
|---|---|---|
| CN | 103857819 A | 6/2014 |
| CN | 104508163 A | 4/2015 |

(Continued)

OTHER PUBLICATIONS

May 9, 2017 Search Report issue in International Patent Application No. PCT/JP2017/002614.

(Continued)

*Primary Examiner* — Christopher S Kessler

(74) *Attorney, Agent, or Firm* — Oliff PLC

(57) ABSTRACT

A high-strength steel sheet for warm working having excellent warm workability, and a method for manufacturing the steel sheet. The steel sheet has a chemical composition including, by mass %, C: 0.05% to 0.20%, Si: 3.0% or less, Mn: 3.5% to 8.0%, P: 0.100% or less, S: 0.02% or less, Al: 0.01% to 3.0%, N: 0.010% or less, one or more selected from Nb: 0.005% to 0.20%, Ti: 0.005% to 0.20%, Mo: 0.005% to 1.0%, and V: 0.005% to 1.0%. The steel sheet has a microstructure including, in terms of area ratio, 10% to 60% of retained austenite, 10% to 80% of ferrite, 10% to 50% of martensite, and 0% to 5% of bainite, in which a C content in the retained austenite is less than 0.40 mass % and the average crystal grain diameter of the retained austenite, the martensite, and the ferrite is 2.0 μm or less.

20 Claims, No Drawings

(56) References Cited

U.S. PATENT DOCUMENTS

| | | | |
|---|---|---|---|
| 2014/0103684 | A1 | 4/2014 | Takagi et al. |
| 2014/0205488 | A1 | 7/2014 | Jun et al. |
| 2014/0308156 | A1 | 10/2014 | Oh et al. |

FOREIGN PATENT DOCUMENTS

| | | | |
|---|---|---|---|
| EP | 2 703 512 | A1 | 3/2014 |
| EP | 2765212 | A1 | 8/2014 |
| EP | 2881481 | A1 | 6/2015 |
| EP | 3 170 912 | A1 | 5/2017 |
| JP | 2001-11565 | A | 1/2001 |
| JP | 2012-031509 | A | 2/2012 |
| JP | 2012-251239 | A | 12/2012 |
| JP | 2014-062286 | A | 4/2014 |
| JP | 2015-503023 | A | 1/2015 |
| WO | 2009/142362 | A1 | 11/2009 |
| WO | 2011/093319 | A1 | 8/2011 |
| WO | 2016/010144 | A1 | 1/2016 |

OTHER PUBLICATIONS

H. Karbasian et al. "A Review on Hot Stamping" Journal of Materials Processing Technology, vol. 210, 2010, pp. 2103-2118.
Nov. 20, 2018 extended European Search Report issued in European Application No. 17744283.7.
Jan. 20, 2020 Office Action issued in Chinese Patent Application No. 201780008401.3.
Jul. 2, 2021 Office Action issued in U.S. Appl. No. 16/073,397.

* cited by examiner

HIGH-STRENGTH STEEL SHEET FOR WARM WORKING AND METHOD FOR MANUFACTURING THE SAME

TECHNICAL FIELD

The present disclosure relates to a high-strength steel sheet for warm working excellent in terms of warm workability and yield ratio after warm working has been performed and a method for manufacturing the steel sheet.

BACKGROUND ART

There is a demand for increasing the strength of a steel sheet which is used for automobile parts from the viewpoint of improving collision safety and fuel efficiency through weight reduction of automobiles. However, since an increase in the strength of materials such as a steel sheet generally causes a deterioration in workability thereof, there is a demand for developing a steel sheet excellent in terms of both strength and workability. In addition, such materials are also required to be excellent in terms of deformation resistance and collision resistance from the viewpoint of occupant safety at the time of a collision or the like.

Against such a background, steel sheets having various properties have been developed. Patent Literature 1 discloses a technique regarding a TRIP steel sheet having impact energy-absorbing capability and elongation (hereinafter, referred to as "EL") which are increased by utilizing retained austenite. Non Patent Literature 1 discloses a technique in which, while high workability has been achieved by performing processing following heating to a temperature range in which an austenite single phase is formed, high strength is achieved with a low C content by performing rapid cooling after the processing. Patent Literature 2 discloses a retained-austenite-containing steel sheet which is excellent in terms of both elongation and strength even in the case where a heating temperature is decreased to 300° C.

CITATION LIST

Patent Literature

PTL 1: Japanese Unexamined Patent Application Publication No. 2001-11565

PTL 2: Japanese Unexamined Patent Application Publication No. 2014-62286

Non Patent Literature

NPL 1: H. Karbasian and A. E. Tekkaya: Journal of Materials Processing Technology, 210 (2010), pp. 2103 to 2118.

SUMMARY

Technical Problem

However, since the steel sheet according to Patent Literature 1 described above is excellent in terms of impact energy-absorbing capability only in the case of a high strain of 10% or more, it is not possible to use such a steel sheet for a part such as a side-collision part which is to be prevented from deforming from the viewpoint of securing an occupant space. In addition, since the carbon content in retained austenite is increased in order to form retained austenite which is stable at room temperature, there is a decrease in yield ratio due to martensite having a high C content which is formed after processing has been performed.

In the case of the technique disclosed in Non Patent Literature 1, since there is a problem of an increase in crystal grain diameter due to high-temperature heating and a problem of a decrease in yield ratio due to residual of fresh martensite and the like. In addition, since equipment for heating a steel sheet to a high temperature is necessary, there is an increase in running costs. Therefore, there is a demand for decreasing the heating temperature.

In the case of the steel sheet according to Patent Literature 2, there is also a problem regarding yield ratio after processing has been performed due to a high C content of 0.5 mass % or more in retained austenite, and there is still an insufficient decrease in warm heating temperature.

As described above, there is no example of a high-strength steel sheet for warm working having excellent workability even with a low heating temperature of about 50° C. to 200° C. and a high strength and a high yield ratio after processing has been performed, and there is a demand for developing such a steel sheet.

An object of the present disclosure is to provide a high-strength steel sheet for warm working having excellent warm workability and a high yield ratio after warm working has been performed and a method for manufacturing the steel sheet.

Solution to Problem

The present inventors diligently conducted investigations in order to achieve the object described above and, as a result, found as follows.

It is possible to achieve a high strength, excellent warm workability, and a high yield ratio after warm working has been performed in the case where a steel sheet has a chemical composition containing, by mass %, C: 0.05% to 0.20%, Si: 3.0% or less, Mn: 3.5% to 8.0%, P: 0.100% or less, S: 0.02% or less, Al: 0.01% to 3.0%, N: 0.010% or less, one or more selected from Nb: 0.005% to 0.20%, Ti: 0.005% to 0.20%, Mo: 0.005% to 1.0%, V: 0.005% to 1.0%, and the balance being Fe and inevitable impurities and a microstructure including, in terms of area ratio, 10% to 60% of retained austenite, 10% to 80% of ferrite, 10% to 50% of martensite, and 0% to 5% of bainite, in which the C content in the retained austenite is less than 0.40 mass %, the average crystal grain diameter of each of the retained austenite, the martensite, and the ferrite is 2.0 μm or less, and carbides containing at least one selected from Nb, Ti, Mo, and V are present at grain boundaries.

Conventionally, it is considered that retained austenite having a low C content is a phase to be avoided, because there is a problem, for example, in that such retained austenite, which is collaterally formed in the case where a sufficient austempering treatment is not performed, is poor in terms of workability at room temperature and prone to changing over time due to poor stability. Therefore, consideration has hardly been given to a method for forming a large amount of retained austenite having a low C content, and there is insufficient knowledge regarding such a method. In addition, even in the case where retained austenite is formed, retained austenite has a C content of about 0.7% or more in most cases. However, the present inventors devised a method in which warm workability is significantly improved and high strength is achieved at room temperature by further decreasing the C content in retained austenite than in conventional retained austenite and by forming a large amount of stable retained austenite and in which yield ratio is improved by further placing carbides at grain boundaries. In addition, it was found that it is possible to realize such effects by precisely controlling the contents of C, Mn, and other alloy chemical elements and annealing conditions.

Here, in the present disclosure, the term "high strength" denotes a case where tensile strength (hereinafter, also referred to as "TS") at room temperature is 1180 MPa or more and Vickers hardness HV at room temperature after warm working has been performed is 400 or more, the term "high yield ratio" denotes a case where a yield ratio at room temperature after warm working has been performed is 60% or more, and the term "excellent warm workability" denotes a case where EL at a temperature of 150° C. is 27% or more. In addition, steel sheets include a cold rolled steel sheet and a hot-rolled steel sheet, and a galvanized steel sheet and a galvannealed steel sheet which are manufactured from the hot-rolled steel sheet or the cold-rolled steel sheet. In the case where it is necessary to distinguish among the steel sheets, individual appropriate terms will be used.

The disclosed exemplary embodiments of the present disclosure are as follows.

[1] A high-strength steel sheet for warm working, having a chemical composition containing, by mass %, C: 0.05% to 0.20%, Si: 3.0% or less, Mn: 3.5% to 8.0%, P: 0.100% or less, S: 0.02% or less, Al: 0.01% to 3.0%, N: 0.010% or less, one or more selected from Nb: 0.005% to 0.20%, Ti: 0.005% to 0.20%, Mo: 0.005% to 1.0%, and V: 0.005% to 1.0%, the balance being Fe and inevitable impurities and a steel sheet microstructure including, in terms of area ratio, 10% to 60% of retained austenite, 10% to 80% of ferrite, 10% to 50% of martensite, and 0% to 5% of bainite, in which a C content in the retained austenite is less than 0.40 mass %, the average crystal grain diameter of each of the retained austenite, the martensite, and the ferrite is 2.0 μm or less, and carbides containing at least one selected from Nb, Ti, Mo, and V are present at grain boundaries.

[2] The high-strength steel sheet for warm working according to item [1], in which the average particle diameter of the carbides containing at least one selected from Nb, Ti, Mo, and V is 200 nm or less.

[3] The high-strength steel sheet for warm working according to item [1] or [2], in which the chemical composition further contains, by mass %, one or more selected from Cr: 0.005% to 2.0%, Ni: 0.005% to 2.0%, Cu: 0.005% to 2.0%, B: 0.0001% to 0.0050%, Ca: 0.0001% to 0.0050%, REM: 0.0001% to 0.0050%, Sn: 0.01% to 0.50%, and Sb: 0.0010% to 0.10%.

[4] The high-strength steel sheet for warm working according to any one of items [1] to [3], the steel sheet further having a zinc-coating layer or an alloyed zinc-coating layer on a surface of the steel sheet.

[5] A method for manufacturing a high-strength steel sheet for warm working, the method including a hot rolling process in which hot rolling is performed on steel having the chemical composition according to item [1] or [3] to obtain a hot-rolled steel sheet, a pickling process in which pickling is performed on the hot-rolled steel sheet, a heating process for annealing in which the pickled steel sheet is heated at an average heating rate of 10° C./s or more in a temperature range of 300° C. to 500° C., a holding process for annealing in which the heated steel sheet is further heated to a temperature range of 680° C. (not inclusive) to 720° C. and held in the temperature range for 1 second to 30 seconds, and a cooling process for annealing in which the held steel sheet is cooled at an average cooling rate of more than 10° C./s in a temperature range from the Ms temperature to room temperature.

[6] The method for manufacturing a high-strength steel sheet for warm working according to item [5], the method further including a cold rolling process in which cold rolling is performed after the pickling process to obtain a cold-rolled steel sheet so that the cold-rolled steel sheet is subjected to the heating process for annealing.

[7] The method for manufacturing a high-strength steel sheet for warm working according to item [5] or [6], the method further including performing a zinc coating treatment after the holding process for annealing and before the cooling process for annealing.

[8] The method for manufacturing a high-strength steel sheet for warm working according to item [7], the method further including performing an alloying treatment after the zinc coating treatment and before the cooling process for annealing.

[9] A method for manufacturing a high-strength steel sheet for warm working, the method including a heating process for annealing in which a hot-rolled steel sheet or a cold-rolled steel sheet having the chemical composition according to item [1] or [3] is heated at an average heating rate of 10° C./s or more in a temperature range of 300° C. to 500° C., a holding process for annealing in which the heated steel sheet is further heated to a temperature range of 680° C. (not inclusive) to 720° C. and held in the temperature range for 1 second to 30 seconds, and a cooling process for annealing in which the held steel sheet is cooled at an average cooling rate of more than 10° C./s in a temperature range from the Ms temperature to room temperature.

Advantageous Effects

According to the present disclosure, it is possible to obtain a high-strength steel sheet for warm working excellent in terms of warm workability and yield ratio after warm working has been performed.

DESCRIPTION OF EMBODIMENTS

Hereafter, the embodiments of the present disclosure will be described. Here, "%" used when describing the contents (also simply referred to as "amount") of the constituent chemical elements denotes "mass %", unless otherwise noted.

1) Chemical Composition

C: 0.05% to 0.20%

C is a chemical element which is effective for increasing HV after warm working has been performed and EL when warm working is performed (EL at a temperature of 150° C. which corresponds to a temperature at which warm working is performed) by forming martensite and retained austenite. It is not possible to sufficiently realize such an effect in the case where the C content is less than 0.05%. On the other hand, in the case where the C content is more than 0.20%, since there is an increase in the C content in retained austenite, there is a decrease in yield ratio after warm working has been performed. Therefore, the C content is set to be 0.05% to 0.20%. It is preferable that the lower limit of the C content be 0.10% or more. It is preferable that the upper limit of the C content be 0.20% or less.

Si: 3.0% or Less

Si is a chemical element which is effective for increasing TS and HV after warm working has been performed through the solid-solution strengthening of steel. It is preferable that the Si content be 0.01 mass % or more in order to realize such an effect. On the other hand, in the case where the Si content is more than 3.0%, there is a decrease in yield ratio after warm working has been performed. Therefore, the Si content is set to be 3.0% or less, preferably 2.5% or less, or more preferably 2.0% or less.

Mn: 3.5% to 8.0%

Mn is a chemical element which is effective for increasing HV after warm working has been performed and EL in a warm temperature range by forming martensite and retained austenite and which is effective for decreasing the C content in retained austenite. In the case where the Mn content is less than 3.5%, it is not possible to sufficiently realize such effects, and bainite, which is undesirable in the present disclosure, tends to be formed. On the other hand, in the case where the Mn content is more than 8.0%, there is a decrease in yield ratio after warm working has been performed. Therefore, the Mn content is set to be 3.5% to 8.0%, or preferably 3.5% to 7.0%. In addition, it is preferable that the lower limit of the Mn content be more than 3.5%, more preferably more than 4.0%, or even more preferably 4.5% or more.

P: 0.100% or Less

Since P deteriorates warm workability through the embrittlement of steel, it is desirable that the P content be as small as possible, but it is acceptable that the P content be 0.100% or less, or preferably 0.02% or less, in the present disclosure. Although there is no particular limitation on the lower limit of the P content, it is preferable that the lower limit be 0.001% or more, because there is a decrease in productive efficiency in the case where the P content is less than 0.001%.

S: 0.02% or Less

Since S deteriorates warm workability through the embrittlement of steel, it is desirable that the S content be as small as possible, but it is acceptable that the S content be 0.02% or less, or preferably 0.005% or less, in the present disclosure. Although there is no particular limitation on the lower limit of the S content, it is preferable that the lower limit be 0.0005% or more, because there is a decrease in productive efficiency in the case where the S content is less than 0.0005%.

Al: 0.01% to 3.0%

Al is a chemical element which is effective for forming ferrite by promoting the formation of ferrite. In the case where the Al content is more than 3.0%, there is a decrease in yield ratio after warm working has been performed. Therefore, the Al content is set to be 3.0% or less, preferably 1.5% or less, or more preferably 1.0% or less. On the other hand, the Al content is set to be 0.01% or more, or preferably, 0.02% or more from the viewpoint of deoxidation in a steel-making process.

N: 0.010% or Less

Since N decreases a yield ratio after warm working has been performed by increasing the hardness of martensite, it is desirable that the N content be as small as possible, but it is acceptable that the N content be 0.010% or less, or preferably 0.007% or less, in the present disclosure. Although there is no particular limitation on the lower limit of the N content, it is preferable that the lower limit be 0.0005% or more, because there is a decrease in productive efficiency in the case where the N content is less than 0.0005%.

One or More Selected from Nb: 0.005% to 0.20%, Ti: 0.005% to 0.20%, Mo: 0.005% to 1.0%, and V: 0.005% to 1.0%

Nb, Ti, Mo, and V improve a yield ratio after warm working has been performed by forming a fine microstructure and fine grain-boundary carbides. That is, while interface-moving velocity is decreased by increasing the Mn content to the level required in the present disclosure, by inhibiting grain growth when annealing is performed through the pinning effect of the fine grain-boundary carbides, fine grain-boundary carbides are placed at grain boundaries while a fine microstructure is formed, and thereby there is a significant increase in yield ratio after warm working has been performed. It is not possible to realize such an effect in the case where the content of each of Nb, Ti, Mo, and V is less than the corresponding lower limit described above. On the other hand, in the case where the content of each of Nb, Ti, Mo, and V is more than the corresponding upper limit described above, since there is a decrease in C content in austenite, it is not possible to form retained austenite in the amount required in the present disclosure. Therefore, in the case where at least one selected from Nb, Ti, Mo, and V is added, the Nb content is set to be 0.005% to 0.20%, the Ti content is set to be 0.005% to 0.20%, the Mo content is set to be 0.005% to 1.0%, and the V content is set to be 0.005% to 1.0%. It is preferable that the lower limit of the Ti content be 0.010% or more. It is preferable that the lower limit of the Nb content be 0.010% or more. It is preferable that the lower limit of the Mo content be 0.02% or more. It is preferable that the lower limit of the V content be 0.05% or more. It is preferable that the upper limit of the Ti content be 0.050% or less. It is preferable that the upper limit of the Nb content be 0.030% or less. It is preferable that the upper limit of the Mo content be 0.30% or less. It is preferable that the upper limit of the V content be 0.2% or less.

The remainder is Fe and inevitable impurities. Here, one or more of the following chemical elements (optional chemical elements) may appropriately be added as needed.

One or more selected from Cr: 0.005% to 2.0%, Ni: 0.005% to 2.0%, Cu: 0.005% to 2.0%, B: 0.0001% to 0.0050%, Ca: 0.0001% to 0.0050%, REM: 0.0001% to 0.0050%, Sn: 0.01% to 0.50%, and Sb: 0.0010% to 0.10%

Cr, Ni, and Cu are chemical elements which are effective for increasing strength by forming martensite. It is preferable that the content of each of Cr, Ni, and Cu be 0.005% or more, or more preferably 0.05% or more, in order to realize such an effect. In the case where the content of each of Cr, Ni, and Cu is more than 2.0%, there may be a decrease in yield ratio after warm working has been performed. It is preferable that the content of each of Cr, Ni, and Cu be 1.0% or less.

B is a chemical element which is effective for increasing strength by forming martensite. It is preferable that the B content be 0.0001% or more, or more preferably 0.0005% or more, in order to realize such an effect. In the case where the B content is more than 0.0050%, there may be a deterioration in warm workability due to an increase in the amount of inclusions. It is preferable that the B content be 0.0040% or less.

Ca and REM are chemical elements which are effective for improving warm workability by controlling the shape of inclusions. It is preferable that the content of each of Ca and REM be 0.0001% or more, or more preferably 0.0005% or more, in order to realize such an effect. In the case where the content of each of Ca and REM is more than 0.0050%, there may be a deterioration in warm workability due to an increase in the amount of inclusions. It is preferable that the content of each of Ca and REM be 0.0040% or less.

Sn and Sb are chemical elements which are effective for inhibiting a decrease in the strength of steel by inhibiting decarburization, denitrification, boron removal, and so forth. The Sn content is set to be 0.01% or more, or preferably 0.03% or more, in order to realize such an effect. In addition, it is preferable that the Sb content be 0.0010% or more, or more preferably 0.01% or more. In the case where the Sn content is more than 0.50% or the Sb content is more than 0.10%, there may be a deterioration in warm workability due to the embrittlement of steel. In addition, it is preferable that the upper limit of the Sn content be 0.05% or less. It is preferable that the upper limit of the Sb content be 0.05% or less.

Therefore, regarding the contents of Cr, Ni, Cu, B, Ca, REM, Sn, and Sb, it is preferable that the Cr content be 0.005% to 2.0%, the Ni content be 0.005% to 2.0%, the Cu content be 0.005% to 2.0%, the B content be 0.0001% to 0.0050%, the Ca content be 0.0001% to 0.0050%, the REM content be 0.0001% to 0.0050%, the Sn content be 0.01% to 0.50%, and the Sb content be 0.0010% to 0.10%.

In addition, in the present disclosure, Zr, Mg, La, and Ce may be added in a total amount of 0.002% or less in addition to the chemical elements described above.

In addition, in the case where the optional chemical elements described above are contained in amounts less than the corresponding lower limits, such chemical elements are regarded as inevitable impurities.

2) Steel Sheet Microstructure

In the description below, the area ratio of a steel sheet microstructure will be simply expressed in units of "%". In the case where a steel sheet has a zinc-coating layer or an alloyed zinc-coating layer, a base steel sheet without such a layer will be discussed.

Retained Austenite: 10% to 60%

In the case where the area ratio of retained austenite is less than 10%, it is not possible to achieve an EL of 27% or more when warm working is performed. On the other hand, in the case where the area ratio is more than 60%, there is a decrease in yield ratio after warm working has been performed. Therefore, the area ratio of retained austenite is set to be 10% to 60%. It is preferable that the lower limit of the area ratio be 15% or more, more preferably 20% or more or more than 20%, even more preferably 30% or more or more than 30%, or even much more preferably 35% or more. It is preferable that the upper limit of the area ratio be 55% or less.

Ferrite: 10% to 80%

In the case where the area ratio of ferrite is less than 10%, it is not possible to achieve both of an EL of 27% or more when warm working is performed and a satisfactory yield ratio after warm working has been performed. On the other hand, in the case where the area ratio is more than 80%, it is not possible to achieve the high strength required in the present disclosure. Therefore, the area ratio of ferrite is set to be 10% to 80%, preferably 10% to 60%, or more preferably 10% to 50%.

Martensite: 10% to 50%

In the case where the area ratio of martensite is less than 10%, it is not possible to achieve a TS of 1180 MPa or more at room temperature. On the other hand, in the case where the area ratio is more than 50%, it is not possible to achieve an EL of 27% or more when warm working is performed. Therefore, the area ratio of martensite is set to be 10% to 50%. It is preferable that the lower limit of the area ratio be 15% or more, more preferably more than 20%, or even more preferably 25% or more. It is preferable that the upper limit of the area ratio be 45% or less.

Bainite: 0% to 5%

Although bainite is undesirable in the present disclosure, it is acceptable that the area ratio of bainite be 5% or less. In the case where the area ratio is more than 5%, there is a decrease in yield ratio after warm working has been performed. Therefore, the area ratio of bainite is set to be 0% to 5%, preferably 0% to 3%, or more preferably 0% to 1%.

The steel sheet microstructure according to the present disclosure includes only retained austenite, ferrite, and martensite and does not include other phases (with the exception of bainite). The total area ratio of retained austenite, ferrite, and martensite is 95% or more. For example, pearlite is not included.

C Content in Retained Austenite: Less than 0.40 Mass %

As described below, the C content in retained austenite is calculated by using equation (1) and equation (2) below. In the case where the C content in retained austenite is 0.40 mass % or more, it is not possible to achieve the high yield ratio required in the present disclosure after warm working has been performed. Therefore, the C content in retained austenite is set to be less than 0.40 mass %, preferably less than 0.3 mass %, or more preferably less than 0.2 mass %.

Average Crystal Grain Diameter of Each of Retained Austenite, Martensite, and Ferrite: 2.0 μm or Less In the case where the average crystal grain diameter of at least one of retained austenite, martensite, and ferrite is more than 2.0 μm, it is not possible to achieve the high yield ratio required in the present disclosure after warm working has been performed. Therefore, the average crystal grain diameter of each of retained austenite, martensite, and ferrite is set to be 2.0 μm or less, or preferably 1.0 μm or less.

Carbides Existing at Grain Boundaries and Containing at Least One Selected from Nb, Ti, Mo, and V By placing fine carbides containing Nb, Ti, Mo, or V at grain boundaries, the movement of dislocations in the vicinity of grain boundaries is inhibited, and therefore there is an increase in yield ratio after warm working has been performed.

By controlling the average particle diameter of such carbides to be 200 nm or less, it is possible to further improve yield ratio after warm working has been performed. Although there is no particular limitation on the lower limit of the average particle diameter, it is preferable that the average particle diameter be 10 nm or more, because there is a decrease in the effect described above in the case where the average particle diameter is less than 10 nm.

In the present disclosure, the average particle diameter of such carbides was defined as the average value of the particle diameters of all carbides observed in 10 fields of view by using a transmission electron microscope (TEM) at a magnification of 100000 times.

In the present disclosure, the term "the area ratio" of each of ferrite, martensite, and bainite denotes the proportion of the area of the corresponding phase to the observed area. The area ratio of each of these phases is derived by taking a sample from a steel sheet, by polishing a thickness cross section parallel to the rolling direction of the steel sheet, by etching the polished cross section through the use of a 3% nital solution, by taking image data through the use of a SEM (scanning electron microscope) at a magnification of 1500 times in 3 microscopic fields at a position of ¼ of the thickness of the steel sheet, by calculating the area ratio of the corresponding phase from the obtained image data through the use of Image-Pro, produced by Media Cybernetics, Inc., and by calculating the average value of the three values of the calculated area ratio of the corresponding phase. In the image data, ferrite is identified as black parts, martensite and retained austenite are identified as white parts, and bainite is identified as dark gray parts including carbides having the same orientation or island-type martensite. The area ratio of martensite is calculated by subtracting the area ratio of retained austenite described below from the area ratio of the white parts in the microstructure. Here, in the present disclosure, martensite may include auto-tempered martensite including carbides having random orientations and tempered martensite. In addition, pearlite is identified as alternating layers of black portions and white portions, although pearlite is not included in the present disclosure.

The average crystal grain diameter of each of ferrite, martensite, and retained austenite is derived by determining crystal grain diameters of the corresponding phase through the use of a cutting method from the image data which are used for deriving the area ratio and by calculating the average value of the determined values. The number of lines used in a cutting method was 10 in the vertical direction and 10 in the horizontal direction so that each of the lengths in both directions of the image was divided into 11 equal parts. Martensite and retained austenite are not distinguished from each other regarding the grain diameter. Here, packet boundaries or block boundaries are not included in "grain boundaries" in the present disclosure.

The volume fraction of retained austenite is derived by grinding the surface of a steel sheet in the thickness direction to the position located at ¼ of the thickness, by further performing chemical polishing on the ground surface in order to remove a thickness of 0.1 mm, by determining, through the use of an X-ray diffractometer with the Kα-ray of Mo, the integrated reflection intensities from the (200)-plane, (220)-plane, and (311)-plane of fcc-iron (austenite) and from the (200)-plane, (211)-plane, and (220)-plane of bcc-iron (ferrite), and by calculating the ratio of the integrated reflection intensity from the planes of fcc-iron to the integrated reflection intensity from the planes of bcc-iron. In the present disclosure, the volume fraction is used as the area ratio.

In addition, the lattice constant a of retained austenite is obtained by determining the amount of diffraction peak shift of the (220)-plane through the use of an X-ray diffractometer with the Kα-ray of Co and by calculating the lattice constant by using equation (1) from the determined amount, and the C content in retained austenite is calculated by using equation (2).

[Math. 1]

$$a=0.17889\cdot(2^{0.5})/\sin\theta \quad (1),$$

where a denotes the lattice constant (nm) of retained austenite and θ denotes a value calculated by dividing the diffraction peak angle (rad) of the (200)-plane by 2.

$$a=0.3578+0.0033[C]+0.000095[Mn]+0.00006[Cr]+0.0022[N]+0.00056[Al]+0.00015[Cu]+0.00031[Mo] \quad (2),$$

where a denotes the lattice constant (nm) of retained austenite and, under the assumption that symbol M is used instead of the atomic symbol of some chemical element, symbol [M] denotes the content (mass %) of the chemical element denoted by symbol M in austenite.

In the present disclosure, the content (mass %) of a chemical element denoted by symbol M (other than C) in retained austenite is regarded as equal to the content in the whole steel. By substituting a and the contents of chemical elements other than C into equation (2), it is possible to calculate the C content in retained austenite.

The steel sheet according to the present disclosure may have a zinc-coating layer or an alloyed zinc-coating layer on the surface thereof. The chemical composition of a zinc-coating layer may contain, for example, Al: 0.05% to 0.25% and the balance being Zn and inevitable impurities.

3) Manufacturing Conditions

It is possible to manufacture the high-strength steel sheet for warm working according to the present disclosure by using, for example, a manufacturing method including a heating process for annealing in which a hot-rolled steel sheet or a cold-rolled steel sheet, which is manufactured by performing hot rolling and, optionally, cold rolling on steel such as a slab having the chemical composition described above, is heated at an average heating rate of 10° C./s or more in a temperature range of 300° C. to 500° C., a holding process for annealing in which the heated steel sheet is further heated to a temperature range of 680° C. (not inclusive) to 720° C. and held in the temperature range for 1 second to 30 seconds, and a cooling process for annealing in which the held steel sheet is cooled at an average cooling rate of more than 10° C./s in a temperature range from the Ms temperature to room temperature. In the first heating process for annealing, a microstructure including fine ferrite and austenite in which fine carbides are placed at the grain boundaries of the ferrite and the austenite is formed by forming carbides containing at least one of Nb, Ti, Mo, and V while Fe-based carbides are dissolved and by forming austenite while the growth of recrystallized ferrite grains is inhibited by the pinning effect of the formed carbides. In the subsequent holding process for annealing in a temperature range in which a dual phase including ferrite and austenite is formed, chemical element distribution is controlled by appropriately controlling the holding time. Moreover, in the subsequent cooling process for annealing, since the diffusion of C from martensite, which has been formed in advance, to adjacent remaining austenite is inhibited by controlling the average cooling rate to be more than 10° C./s in a temperature range equal to or lower than the Ms temperature, it is possible to form a fine microstructure (steel sheet microstructure) including retained austenite having a low C content, ferrite, and martensite according to the present disclosure. Hereafter, the manufacturing conditions will be described in detail. Here, in the description of the manufacturing conditions, "s" used when describing a period of time denotes second.

First, the annealing process including the heating process for annealing, the holding process for annealing, and the cooling process for annealing will be described. A hot-rolled steel sheet or a cold-rolled steel sheet is subjected to the annealing process.

Heating at an average heating rate of 10° C./s or more in a temperature range from 300° C. to 500° C.

In the case where the average heating rate in a temperature range from 300° C. to 500° C. is less than 10° C./s, since there is coarsening of ferrite, it is not possible to form the steel sheet microstructure according to the present disclosure. Therefore, the average heating rate in a temperature range from 300° C. to 500° C. is set to be 10° C./s or more. Although there is no particular limitation on the upper limit of the average heating rate, it is preferable that the upper limit be 2000° C./s or less from the viewpoint of operation stability. In addition, it is more preferable that the average heating rate in a temperature range from 300° C. to 500° C. be 1000° C./s or less. Regarding the heating at an average heating rate of 10° C./s or more, in the case where the heating start temperature is higher than 300° C., since there is coarsening of ferrite grain, there may be a case where it is not possible to form the steel sheet microstructure according to the present disclosure. In addition, there is no particular limitation on the average heating rate used when heating is performed from 500° C. to the annealing temperature described below.

Annealing Temperature: 680° C. (not Inclusive) to 720° C.

In the case where the annealing temperature is 680° C. or lower, austenite is not formed, or, even in the case where austenite is formed, it is not possible to achieve the warm workability or the high yield ratio after warm working according to the present disclosure due to excessive concentration of C and Mn. On the other hand, in the case where the annealing temperature is higher than 720° C., since there is a decrease in the amounts of ferrite and retained austenite, there is insufficient warm workability. Therefore, the annealing temperature is set to be 680° C. (not inclusive) to 720° C.

Holding Time for Annealing: 1 Second to 30 Seconds

In the case where the annealing time is less than 1 second, since there is an insufficient amount of austenite formed, it is not possible to form the steel sheet microstructure according to the present disclosure. On the other hand, in the case where the holding time is more than 30 seconds, since there is coarsening of crystal grain, it is not possible to form the steel sheet microstructure according to the present disclosure. Therefore, the holding time for annealing is set to be 1 second to 30 seconds.

Zinc-Coating Treatment

A zinc-coating treatment may be performed on the steel sheet after the holding process for annealing and before the cooling process for annealing. It is preferable that a zinc-coating treatment be performed in a zinc-coating bath having a chemical composition containing 0.10% to 0.25% of Al and the balance being zinc and inevitable impurities. Moreover, an alloying treatment may further be performed. It is preferable that an alloying treatment be performed at a temperature of 460° C. to 600° C. for a holding time of 1 second to 60 seconds.

In addition, in the case where a coating treatment is performed, the treatment should be performed in the middle of cooling from the end of the holding process for annealing described above to the Ms temperature. In the case where a coating treatment is performed after cooling has been performed to a temperature equal to or lower than the Ms temperature, it is not possible to form the steel sheet microstructure according to the present disclosure, and it is not possible to achieve the warm workability or the high yield ratio after warm working according to the present disclosure.

In the present disclosure, the Ms temperature (° C.) is determined by using Formaster.

Cooling at an Average Cooling Rate of More than 10° C./s in a Temperature Range from the Ms Temperature to Room Temperature Cooling is performed to the Ms temperature after the treatments described above or after the holding for annealing process. Subsequently, cooling is further performed at an average cooling rate of more than 10° C./s in a temperature range from the Ms temperature to room temperature. In the case where the average cooling rate in a temperature range from the Ms temperature to room temperature is 10° C./s or less, since there is an increase in the C content in retained austenite due to the diffusion of C, there is a deterioration in warm workability and decrease in yield ratio after warm working has been performed. Therefore, the average cooling rate in a temperature range from the Ms temperature to room temperature is set to be more than 10° C./s. Here, heating should not be performed in the middle of cooling from the Ms temperature to room temperature, because there is also an increase in C content in retained austenite due to the diffusion of C in the case where reheating is performed in the middle of cooling from the Ms temperature to room temperature. Although there is no particular limitation on the upper limit of the average cooling rate, it is preferable that the upper limit of the average cooling rate be 1000° C./s or less, because there is an increase in costs due to excessive cooling equipment being necessary in the case where the average cooling rate is more than 1000° C./s. Here, the term "room temperature" denotes a temperature of 0° C. to 50° C.

There is no particular limitation on the condition of a manufacturing method used before the annealing process described above, and it is preferable that, for example, the conditions described below be used.

It is preferable that a slab be manufactured by using a continuous casting method in order to prevent macro segregation, and a slab may be manufactured also by using an ingot-making method or a thin-slab casting method. When the slab is subjected to hot rolling, hot rolling may be performed after the slab has been subjected to reheating following cooling to room temperature, hot rolling may be performed after the slab has been charged into a heating furnace without being cooled to room temperature, or an energy-saving process, in which hot rolling is performed immediately after the slab has been subjected to heat retention for a short time, may be used. In the case where the slab is heated, it is preferable that the slab temperature be 1100° C. or higher in order to dissolve carbides and in order to prevent an increase in rolling load. In addition, it is preferable that the slab temperature be 1300° C. or lower in order to prevent an increase in the amount of scale loss. Here, the slab temperature is represented by the surface temperature of the slab. When the slab is subjected to hot rolling, a sheet bar, which has been manufactured by performing rough rolling on the slab, may be heated. In addition, a so-called continuous rolling process, in which the sheet bars are connected with each other and finish rolling is continuously performed, may be used. It is preferable that finish rolling be performed with a finishing delivery temperature of 800° C. or higher in order to prevent a deterioration in workability due to an increase in the degree of anisotropy after cold rolling and annealing has been performed. In addition, it is preferable that lubricated rolling be performed with a friction coefficient of 0.10 to 0.25 in all or some of the rolling passes of finish rolling in order to decrease rolling load and in order to homogenize shape and material properties.

A steel sheet which has been coiled is subjected to pickling or the like in order to remove scale. A heat treatment or cold rolling is further performed as needed, and, for example, annealing or zinc-coating treatment is further performed thereafter as needed.

The cold rolling described above should be performed by using a commonly used method. In addition, although there is no particular limitation on the rolling reduction ratio of cold rolling, it is preferable that the rolling reduction ratio be 30% or more, because there may be a case of an inhomogeneous microstructure having, for example, coarse grains or a non-recrystallized microstructure being formed after subsequent annealing in the case where the rolling reduction ratio is less than 30%. In addition, it is preferable that the rolling reduction ratio be 90% or less, because there may be a case of a deterioration in the shape of a steel sheet in the case where the rolling reduction ratio is more than 90%. Here, in the present disclosure, a heat treatment may be performed before cold rolling is performed. In addition, it is preferable that the maximum end-point temperature of a steel sheet in such a heat treatment be 600° C. or lower, because there is a change in microstructure such as the formation of austenite in the case where the maximum end-point temperature is higher than 600° C.

4) Other

In addition, in the present disclosure, it is preferable that a high-strength steel sheet for warm working be used for processing at a temperature of 50° C. to 200° C.

EXAMPLES

Hereafter, the exemplary embodiments of the present disclosure will be specifically described on the basis of examples. The technical scope of the present disclosure is not limited to the examples below.

Molten steels having the chemical compositions given in Table 1 (with the balance being Fe and inevitable impurities) were prepared by using a laboratory vacuum melting furnace and rolled into steel slabs. These steel slabs were subjected to heating to a temperature of 1200° C. followed by rough rolling and finish rolling in order to obtain hot-rolled steel sheets having a thickness of 3.0 mm. The finishing delivery temperature of hot rolling was 900° C., and the coiling temperature was 500° C. Pickling was performed after coiling had been performed. Some of the hot-rolled steel sheets were subjected to annealing (heat treatment) for softening at a temperature of 600° C. for 1 hour followed by cold rolling in order to obtain cold-rolled steel sheets (CR) having a thickness of 1.4 mm. The obtained hot-rolled steel sheets and cold-rolled steel sheets were subjected to annealing.

Annealing was performed in a laboratory by using an apparatus for a heating treatment and a coating treatment under the conditions given in Table 2 in order to obtain steel sheets 1 through 25 including high-strength steel sheets for warm working (HR), which were manufactured by annealing hot-rolled steel sheets, high-strength steel sheets for warm working (CR), which were manufactured by annealing cold-rolled steel sheets, galvanized steel sheets (GI), and galvannealed steel sheets (GA). The galvanized steel sheets were manufactured by dipping the steel sheets in a galvanizing bath having a temperature of 460° C. in order to form coating layers having a coating weight of 35 g/m$^2$ to 45 g/m$^2$, and the galvannealed steel sheets were manufactured by performing an alloying treatment at a temperature of 550° C. for a holding time of 1 second to 60 seconds after the coating layers had been formed. In the case of No. 8 in Table 2, since cooling was performed to a temperature lower than the Ms temperature in the cooling process after the annealing process, "average cooling rate from Ms temperature to room temperature" is not given. In the case of No. 18 in Table 2, cooling was performed to room temperature after the annealing process.

After having performed skin pass rolling with an elongation ratio of 0.3% on the obtained high-strength steel sheets for warm working, which were manufactured by annealing hot-rolled steel sheets, high-strength steel sheets for warm working, which were manufactured by annealing cold-rolled steel sheets, galvanized steel sheets, and galvannealed steel sheets, tensile properties at room temperature, warm tensile properties, and impact resistance after a tensile test were evaluated by using the following testing methods. The results are given in Table 3. In addition, the area ratios of phases and so forth obtained by using the methods described above are also given in Table 3.

<Tensile Test at Room Temperature>

By taking a JIS No. 5 tensile test piece (JIS Z 2201) from the annealed steel sheet (meaning the base steel sheet in the case of the galvanized steel sheet or the galvannealed steel sheet; the same will apply hereinafter) in a direction parallel to the rolling direction, and by performing a tensile test in accordance with JIS Z 2241 at room temperature with a strain rate of $10^{-3}$/s, TS was determined. Here, a case of a TS of 1180 MPa or more was judged as satisfactory. In addition, by applying a tensile strain of 27% to the test piece through the use of the same method as that used in the warm tensile test described below, by cooling the warm test piece to room temperature, by performing a tensile test in accordance with JIS Z 2241 at room temperature with a strain rate of $10^{-3}$/s, and by dividing the obtained yield strength at room temperature by the tensile strength, the yield ratio after warm working has been performed was determined.

<Warm Tensile Test>

By taking a JIS No. 5 tensile test piece (JIS Z 2201) from the annealed steel sheet in a direction parallel to the rolling direction, and by performing a tensile test at a testing temperature of 80° C. or 150° C. with a strain rate of $10^{-3}$/s, EL was determined. Here, in the present disclosure, a case of an EL of 27% or more in the warm tensile test was judged as a case of good warm workability.

<Vickers Hardness Test at Room Temperature after Warm Working has been Performed>

By applying a tensile strain of 27% to the test piece through the use of the same method as that used in the warm tensile test described above, by cooling the warm test piece to room temperature, by performing a Vickers hardness test at five positions located at ¼ of the thickness of the test piece in the thickness cross section parallel to the tensile direction of the central portion of the tensile test piece with a load of 1 kgf, and by calculating the average value of the 3 values other than the maximum and minimum values, the average Vickers hardness HV was determined. Here, in the present disclosure, a case of an HV of 400 or more was judged as a case of high strength.

TABLE 1

| | Chemical Composition (mass %) | | | | | | | | | | | | |
|---|---|---|---|---|---|---|---|---|---|---|---|---|---|
| Steel | C | Si | Mn | P | S | Al | N | Ti | Nb | Mo | V | Other | Note |
| A | 0.15 | 1.50 | 5.5 | 0.015 | 0.001 | 0.030 | 0.003 | 0.030 | — | — | — | B: 0.0010 | within Scope of Disclosure |
| B | 0.15 | 1.50 | 5.5 | 0.015 | 0.001 | 0.030 | 0.003 | — | 0.015 | — | — | Ca: 0.0010 | within Scope of Disclosure |

TABLE 1-continued

| Steel | Chemical Composition (mass %) | | | | | | | | | | | | Note |
|---|---|---|---|---|---|---|---|---|---|---|---|---|---|
| | C | Si | Mn | P | S | Al | N | Ti | Nb | Mo | V | Other | |
| C | 0.15 | 1.50 | 5.5 | 0.015 | 0.001 | 0.030 | 0.003 | — | — | 0.10 | — | B: 0.0010 | within Scope of Disclosure |
| D | 0.15 | 1.50 | 5.5 | 0.015 | 0.001 | 0.030 | 0.003 | — | — | — | 0.15 | — | within Scope of Disclosure |
| E | 0.15 | 0.50 | 7.0 | 0.015 | 0.001 | 1.000 | 0.003 | 0.022 | — | — | — | — | within Scope of Disclosure |
| F | 0.15 | 1.50 | 5.5 | 0.015 | 0.001 | 0.030 | 0.003 | — | — | 0.08 | 0.10 | Cu: 0.1 | within Scope of Disclosure |
| G | 0.15 | 1.50 | 5.5 | 0.015 | 0.001 | 0.030 | 0.003 | 0.015 | 0.010 | — | — | REM: 0.0020 | within Scope of Disclosure |
| H | 0.15 | 1.50 | 5.5 | 0.015 | 0.001 | 0.030 | 0.003 | 0.010 | — | 0.20 | — | Ni: 0.1 | within Scope of Disclosure |
| I | 0.15 | 1.50 | 4.5 | 0.015 | 0.001 | 0.030 | 0.003 | 0.010 | — | — | 0.10 | Cr: 0.3 | within Scope of Disclosure |
| J | 0.15 | 1.50 | 5.5 | 0.015 | 0.001 | 0.030 | 0.003 | — | 0.020 | 0.10 | — | Sb: 0.03 | within Scope of Disclosure |
| K | 0.15 | 1.50 | 5.5 | 0.015 | 0.001 | 0.030 | 0.003 | — | 0.010 | — | 0.05 | Sn: 0.03 | within Scope of Disclosure |
| L | 0.15 | 1.50 | 5.5 | 0.015 | 0.001 | 0.030 | 0.003 | — | — | — | — | — | out of Scope of Disclosure |
| M | 0.03 | 1.50 | 5.5 | 0.015 | 0.001 | 0.030 | 0.003 | — | 0.020 | — | — | — | out of Scope of Disclosure |
| N | 0.25 | 1.50 | 5.5 | 0.015 | 0.001 | 0.030 | 0.003 | — | — | 0.100 | — | — | out of Scope of Disclosure |
| O | 0.15 | 3.50 | 5.5 | 0.015 | 0.001 | 0.030 | 0.003 | 0.010 | — | — | 0.080 | — | out of Scope of Disclosure |
| P | 0.15 | 1.50 | 10.0 | 0.015 | 0.001 | 0.030 | 0.003 | — | 0.010 | — | — | — | out of Scope of Disclosure |
| Q | 0.15 | 1.50 | 3.0 | 0.015 | 0.001 | 0.030 | 0.003 | — | — | 0.200 | — | — | out of Scope of Disclosure |
| R | 0.20 | 1.50 | 8.0 | 0.015 | 0.001 | 0.030 | 0.003 | 0.020 | — | — | — | Cr: 0.5 | within Scope of Disclosure |

TABLE 2

| Steel Sheet No. | Steel | Cold Rolling | Annealing Condition: Average Heating Rate from 300° C. to 500° C. (° C./s) | Annealing Temperature (° C.) | Holding Time for Annealing (s) | Average Cooling Rate (° C./s) | Cooling Stop Temperature (° C.) | Cooling Stop Holding Time (s) | Ms temperature (° C.) | Reheating Temperature (° C.) | Reheating Holding time (s) | Coating Bath Temperature (° C.) | Coating-layer Alloying Temperature (° C.) | Average Cooling Rate from Ms temperature to Room Temperature (° C./s) | *Steel Sheet Surface | Note |
|---|---|---|---|---|---|---|---|---|---|---|---|---|---|---|---|---|
| 1 | A | Done | 15 | 710 | 15 | 15 | 500 | 100 | 190 | — | — | 460 | 550 | 15 | GA | Example |
| 2 | | Done | 15 | 750 | 15 | 15 | 500 | 100 | 280 | — | — | 460 | 550 | 15 | GA | Comparative Example |
| 3 | B | Undone | 15 | 710 | 15 | 15 | 500 | 100 | 170 | — | — | — | — | 15 | HR | Example |
| 4 | | Undone | 15 | 650 | 15 | 15 | 500 | 100 | 120 | — | — | — | — | 15 | HR | Comparative Example |
| 5 | C | Done | 15 | 710 | 15 | 15 | 500 | 100 | 190 | — | — | 460 | — | 15 | GI | Example |
| 6 | | Done | 15 | 710 | 500 | 15 | 500 | 100 | 180 | — | — | 460 | — | 15 | GI | Comparative Example |
| 7 | D | Done | 100 | 700 | 15 | 15 | 500 | 100 | 190 | — | — | 460 | 550 | 15 | GA | Example |
| 8 | | Done | 100 | 700 | 15 | 15 | 150 | 1 | 190 | 400 | 100 | 460 | 550 | — | GA | Comparative Example |
| 9 | E | Done | 15 | 710 | 15 | 5 | 500 | 100 | 190 | — | — | 460 | 550 | 15 | GA | Example |
| 10 | | Done | 15 | 710 | 60 | 5 | 500 | 100 | 190 | — | — | 460 | 550 | 15 | GA | Comparative Example |
| 11 | | Done | 15 | 710 | 15 | 5 | 500 | 100 | 190 | — | — | 460 | 550 | 0.1 | GA | Comparative Example |
| 12 | F | Done | 15 | 710 | 15 | 15 | 500 | 100 | 180 | — | — | 460 | 550 | 15 | GA | Example |
| 13 | | Done | 1 | 710 | 15 | 15 | 500 | 100 | 180 | — | — | 460 | 550 | 15 | GA | Comparative Example |
| 14 | G | Done | 15 | 690 | 15 | 15 | 500 | 100 | 170 | — | — | 460 | 550 | 15 | GA | Example |
| 15 | H | Done | 15 | 700 | 15 | 15 | 500 | 100 | 160 | — | — | 460 | 550 | 15 | GA | Example |
| 16 | I | Done | 15 | 700 | 15 | 15 | 500 | 10 | 220 | — | — | 460 | 550 | 15 | GA | Example |
| 17 | J | Undone | 15 | 700 | 15 | 15 | 500 | 100 | 190 | — | — | 460 | 550 | 15 | GA | Example |
| 18 | K | Done | 15 | 700 | 15 | 15 | — | 0 | 190 | — | — | — | — | 15 | CR | Example |
| 19 | L | Done | 15 | 710 | 15 | 15 | 500 | 100 | 180 | — | — | 460 | 550 | 15 | GA | Comparative Example |
| 20 | M | Done | 15 | 710 | 15 | 15 | 500 | 100 | 250 | — | — | 460 | 550 | 15 | GA | Comparative Example |
| 21 | N | Done | 15 | 700 | 15 | 15 | 500 | 100 | 60 | — | — | 460 | 550 | 15 | GA | Comparative Example |
| 22 | O | Done | 15 | 700 | 15 | 15 | 500 | 100 | 160 | — | — | 460 | 550 | 15 | GA | Comparative Example |
| 23 | P | Done | 15 | 700 | 15 | 15 | 500 | 100 | 50 | — | — | 460 | 550 | 15 | GA | Comparative Example |
| 24 | Q | Done | 15 | 700 | 15 | 15 | 500 | 100 | 110 | — | — | 460 | 550 | 15 | GA | Comparative Example |
| 25 | R | Done | 15 | 700 | 15 | 15 | 500 | 100 | 50 | — | — | 460 | 550 | 15 | GA | Example |

*Steel Sheet Surface: CR, cold-rolled steel sheet; HR, hot-rolled steel sheet; GI, galvanized steel sheet; and GA, galvannealed steel sheet

TABLE 3

| Steel Sheet No. | Steel Sheet Microstructure*1 | | | | | | | | | | |
|---|---|---|---|---|---|---|---|---|---|---|---|
| | V (F) (%) | V (M) (%) | V (γ) (%) | V (B) (%) | Other (%) | C (γ) (%) | d (F) (μm) | d (M) (μm) | d (γ) (μm) | Kind of Grain-boundary Carbide | Average Particle Diameter of Grain-boundary Carbide (μm) |
| 1 | 36 | 21 | 43 | 0 | 0 | 0.12 | 0.8 | 1.2 | 1.2 | Ti | 0.22 |
| 2 | 9 | 85 | 6 | 0 | 0 | 0.01 | 2.1 | 3.8 | 3.8 | Ti | 0.63 |
| 3 | 31 | 24 | 45 | 0 | 0 | 0.13 | 0.9 | 1.0 | 1.0 | Nb | 0.19 |
| 4 | 73 | 6 | 21 | 0 | 0 | 0.43 | 0.9 | 0.7 | 0.7 | Nb | 0.11 |
| 5 | 23 | 32 | 45 | 0 | 0 | 0.14 | 0.7 | 0.8 | 0.8 | Mo | 0.16 |
| 6 | 19 | 35 | 46 | 0 | 0 | 0.11 | 2.3 | 2.8 | 2.8 | Mo | 0.32 |
| 7 | 31 | 31 | 38 | 0 | 0 | 0.10 | 1.0 | 0.9 | 0.9 | V | 0.18 |
| 8 | 30 | 14 | 26 | 0 | 30 | 0.41 | 1.0 | 1.0 | 1.0 | V | 0.19 |
| 9 | 19 | 30 | 51 | 0 | 0 | 0.15 | 0.8 | 1.5 | 1.5 | Ti | 0.24 |
| 10 | 19 | 29 | 52 | 0 | 0 | 0.14 | 1.9 | 2.2 | 2.2 | Ti | 0.28 |
| 11 | 18 | 29 | 53 | 0 | 0 | 0.44 | 0.9 | 1.3 | 1.3 | Ti | 0.23 |
| 12 | 20 | 33 | 47 | 0 | 0 | 0.15 | 0.7 | 0.7 | 0.7 | Mo, V | 0.12 |
| 13 | 20 | 35 | 45 | 0 | 0 | 0.14 | 2.5 | 1.6 | 1.6 | Mo, V | 0.28 |
| 14 | 28 | 24 | 48 | 0 | 0 | 0.19 | 0.7 | 0.8 | 0.8 | Ti, Nb | 0.14 |
| 15 | 22 | 34 | 44 | 0 | 0 | 0.15 | 0.9 | 1.1 | 1.1 | Ti, Mo | 0.22 |
| 16 | 43 | 23 | 34 | 0 | 0 | 0.25 | 1.8 | 1.6 | 1.6 | Ti, V | 0.16 |
| 17 | 30 | 31 | 39 | 0 | 0 | 0.13 | 1.0 | 1.1 | 1.1 | Nb, Mo | 0.15 |
| 18 | 29 | 30 | 41 | 0 | 0 | 0.14 | 0.9 | 1.0 | 1.0 | Nb, V | 0.18 |
| 19 | 21 | 34 | 45 | 0 | 0 | 0.16 | 1.0 | 1.3 | 1.3 | — | — |
| 20 | 39 | 35 | 26 | 0 | 0 | 0.03 | 1.8 | 1.1 | 1.1 | Nb | 0.25 |
| 21 | 10 | 32 | 58 | 0 | 0 | 0.50 | 1.1 | 1.3 | 1.3 | Mo | 0.86 |
| 22 | 27 | 27 | 46 | 0 | 0 | 0.13 | 1.0 | 1.3 | 1.3 | Ti, V | 0.20 |
| 23 | 11 | 32 | 57 | 0 | 0 | 0.10 | 0.8 | 0.9 | 0.9 | Nb | 0.41 |
| 24 | 45 | 19 | 8 | 28 | 0 | 0.38 | 2.4 | 0.9 | 0.9 | Mo | 0.27 |
| 25 | 20 | 21 | 59 | 0 | 0 | 0.13 | 0.8 | 1.2 | 1.2 | Ti | 0.20 |

| Steel Sheet No. | Mechanical Property | | | | | |
|---|---|---|---|---|---|---|
| | Room Temperature TS (MPa) | Warm Temperature Range Processing Temperature (° C.) | EL (%) | Room Temperature after Warm Working HV | Yield Ratio (%) | Note |
| 1 | 1484 | 150 | 40 | 421 | 75 | Example |
| 2 | 1576 | 150 | 10 | — | — | Comparative Example |
| 3 | 1498 | 150 | 42 | 421 | 72 | Example |
| 4 | 1082 | 150 | 25 | — | — | Comparative Example |
| 5 | 1504 | 150 | 44 | 419 | 83 | Example |
| 6 | 1530 | 150 | 37 | 438 | 57 | Comparative Example |
| 7 | 1466 | 150 | 39 | 419 | 72 | Example |
| 8 | 1289 | 150 | 25 | — | — | Comparative Example |
| 9 | 1560 | 150 | 45 | 430 | 68 | Example |
| 10 | 1552 | 150 | 44 | 430 | 58 | Comparative Example |
| 11 | 1510 | 150 | 21 | — | — | Comparative Example |
| 12 | 1537 | 150 | 39 | 436 | 63 | Example |
| 13 | 1528 | 150 | 40 | 431 | 59 | Comparative Example |
| 14 | 1311 | 80 | 31 | 402 | 70 | Example |
| 15 | 1455 | 150 | 36 | 422 | 64 | Example |
| 16 | 1401 | 150 | 39 | 403 | 75 | Example |
| 17 | 1510 | 150 | 43 | 422 | 74 | Example |
| 18 | 1494 | 150 | 43 | 418 | 66 | Example |
| 19 | 1517 | 150 | 43 | 423 | 58 | Comparative Example |
| 20 | 1026 | 150 | 19 | — | — | Comparative Example |
| 21 | 1733 | 150 | 59 | 444 | 55 | Comparative Example |
| 22 | 1507 | 150 | 41 | 425 | 58 | Comparative Example |
| 23 | 1635 | 150 | 49 | 440 | 57 | Comparative Example |
| 24 | 893 | 150 | 38 | 356 | 56 | Comparative Example |
| 25 | 1683 | 150 | 49 | 452 | 75 | Example |

*1V(F): area ratio of ferrite; V(M): area ratio of martensite; V(γ): area ratio of retained austenite; V(B): area ratio of bainite; C(γ): C content (mass %) in retained austenite; d(F): average crystal grain diameter of ferrite; d(M): average crystal grain diameter of martensite; and d(γ): average crystal grain diameter of retained austenite The examples of the present disclosure were all high-strength steel sheets for warm working excellent in terms of yield ratio after warm working had been performed having a TS at room temperature of 1180 MPa or more, a Vickers hardness HV at room temperature after warm working had been performed of 400 or more, a yield ratio after warm working had been performed of 60% or more, and an EL in a warm temperature range of 27% or more. Here, in the case where a warm tensile test was performed on steel sheet No. 14 at a testing temperature of 150° C., the EL in a warm temperature range was 29%, the HV after warm working had been performed was 400 or more, and the yield ratio after warm working had been performed was 60% or more.

On the other hand, in the case of the comparative examples, which were out of the range according to the present disclosure, the desired strength was not obtained, the EL in a warm temperature range was not obtained, or the high yield ratio after warm working had been performed was not obtained.

INDUSTRIAL APPLICABILITY

According to the present disclosure, it is possible to obtain a high-strength steel sheet for warm working having a TS at room temperature of 1180 MPa or more, an EL in a warm temperature range of 27% or more, and an excellent yield ratio after warm working has been performed.

The invention claimed is:

1. A high-strength steel sheet for warm working, the steel sheet having a chemical composition comprising:

C: 0.05% to 0.20%, by mass %;
Si: 3.0% or less, by mass %;
Mn: 3.5% to 8.0%, by mass %;
P: 0.100% or less, by mass %;
S: 0.02% or less, by mass %;
Al: 0.01% to 3.0%, by mass %;
N: 0.010% or less, by mass %;
one or more selected from Nb: 0.005% to 0.20%, by mass %;
Ti: 0.005% to 0.20%, by mass %;
Mo: 0.005% to 1.0%, by mass %;
V: 0.005% to 1.0%, by mass %; and
Fe and inevitable impurities,
wherein:
the steel sheet has a microstructure including, in terms of area ratio, 10% to 60% of retained austenite, 10% to 80% of ferrite, 10% to 50% of martensite, and 0% to 5% of bainite, and
a C content in the retained austenite is less than 0.40 mass %, an average crystal grain diameter of each of the retained austenite, the martensite, and the ferrite is 2.0 μm or less, and carbides containing at least one selected from Nb, Ti, Mo, and V are present at grain boundaries.

2. The high-strength steel sheet for warm working according to claim 1, wherein an average particle diameter of the carbides containing at least one selected from Nb, Ti, Mo, and V is 200 nm or less.

3. The high-strength steel sheet for warm working according to claim 1, wherein the chemical composition further comprises:

one or more selected from Cr: 0.005% to 2.0%, by mass %;
Ni: 0.005% to 2.0%, by mass %;
Cu: 0.005% to 2.0%, by mass %;
B: 0.0001% to 0.0050%, by mass %;
Ca: 0.0001% to 0.0050%, by mass %;
REM: 0.0001% to 0.0050%, by mass %;
Sn: 0.01% to 0.50%, by mass %; and
Sb: 0.0010% to 0.10%, by mass %.

4. The high-strength steel sheet for warm working according to claim 2, wherein the chemical composition further comprises:

one or more selected from Cr: 0.005% to 2.0%, by mass %;
Ni: 0.005% to 2.0%, by mass %;
Cu: 0.005% to 2.0%, by mass %;
B: 0.0001% to 0.0050%, by mass %;
Ca: 0.0001% to 0.0050%, by mass %;
REM: 0.0001% to 0.0050%, by mass %;
Sn: 0.01% to 0.50%, by mass %; and
Sb: 0.0010% to 0.10%, by mass %.

5. The high-strength steel sheet for warm working according to claim 1, the steel sheet further having a zinc-coating layer or an alloyed zinc-coating layer on a surface of the steel sheet.

6. The high-strength steel sheet for warm working according to claim 2, the steel sheet further having a zinc-coating layer or an alloyed zinc-coating layer on a surface of the steel sheet.

7. The high-strength steel sheet for warm working according to claim 3, the steel sheet further having a zinc-coating layer or an alloyed zinc-coating layer on a surface of the steel sheet.

8. The high-strength steel sheet for warm working according to claim 4, the steel sheet further having a zinc-coating layer or an alloyed zinc-coating layer on a surface of the steel sheet.

9. A method for manufacturing the high-strength steel sheet for warm working according to claim 1, the method comprising:

a hot rolling process in which hot rolling is performed on steel to obtain a hot-rolled steel sheet,
a pickling process in which pickling is performed on the hot-rolled steel sheet,
a heating process for annealing in which the pickled steel sheet is heated at an average heating rate of 10° C./s or more in a temperature range of 300° C. to 500° C.,
a holding process for annealing in which the heated steel sheet is further heated to a temperature range of greater than 680° C. and less than or equal to 720° C. and held in the temperature range for 1 second to 30 seconds, and
a cooling process for annealing in which the held steel sheet is cooled at an average cooling rate of more than 10° C./s in a temperature range from Ms temperature to room temperature.

10. The method for manufacturing the high-strength steel sheet for warm working according to claim 9, the method further comprising a cold rolling process in which cold rolling is performed after the pickling process to obtain a cold-rolled steel sheet so that the cold-rolled steel sheet is subjected to the heating process for annealing.

11. The method for manufacturing the high-strength steel sheet for warm working according to claim 9, the method further comprising performing a zinc coating treatment after the holding process for annealing and before the cooling process for annealing.

12. The method for manufacturing the high-strength steel sheet for warm working according to claim 11, the method further comprising performing an alloying treatment after the zinc coating treatment and before the cooling process for annealing.

13. The method for manufacturing the high-strength steel sheet for warm working according to claim 9, wherein:

the steel sheet has a microstructure including, in terms of area ratio, 15% to 55% of retained austenite, 10% to 60% of ferrite, 15% to 45% of martensite, and 0% to 3% of bainite, and a C content in the retained austenite is less than 0.30 mass %, and an average crystal grain diameter of each of the retained austenite, the martensite, and the ferrite is 1.0 μm or less.

14. A method for manufacturing the high-strength steel sheet for warm working according to claim 1, the method comprising:

a heating process for annealing in which a hot-rolled steel sheet or a cold-rolled steel sheet is heated at an average heating rate of 10° C./s or more in a temperature range of 300° C. to 500° C., a holding process for annealing in which the heated steel sheet is further heated to a temperature range of greater than 680° C. and less than or equal to 720° C. and held in the temperature range for 1 second to 30 seconds, and a cooling process for annealing in which the held steel sheet is cooled at an average cooling rate of more than 10° C./s in a temperature range from Ms temperature to room temperature.

15. The method for manufacturing the high-strength steel sheet for warm working according to claim 14, wherein:

the steel sheet has a microstructure including, in terms of area ratio, 15% to 55% of retained austenite, 10% to 60% of ferrite, 15% to 45% of martensite, and 0% to 3% of bainite, and a C content in the retained austenite is less than 0.30 mass %, and an average crystal grain diameter of each of the retained austenite, the martensite, and the ferrite is 1.0 μm or less.

16. A method for manufacturing the high-strength steel sheet for warm working according to claim 3, the method comprising:

a hot rolling process in which hot rolling is performed on steel to obtain a hot-rolled steel sheet, a pickling process in which pickling is performed on the hot-rolled steel sheet, a heating process for annealing in which the pickled steel sheet is heated at an average heating rate of 10° C/s or more in a temperature range of 300° C. to 500° C., a holding process for annealing in which the heated steel sheet is further heated to a temperature range of greater than 680° C. and less than or equal to 720° C. and held in the temperature range for 1 second to 30 seconds, and a cooling process for annealing in which the held steel sheet is cooled at an average cooling rate of more than 10° C/s in a temperature range from Ms temperature to room temperature.

17. The method for manufacturing the high-strength steel sheet for warm working according to claim 16, the method further comprising a cold rolling process in which cold rolling is performed after the pickling process to obtain a cold-rolled steel sheet so that the cold-rolled steel sheet is subjected to the heating process for annealing.

18. The method for manufacturing the high-strength steel sheet for warm working according to claim 16, the method further comprising performing a zinc coating treatment after the holding process for annealing and before the cooling process for annealing.

19. The method for manufacturing the high-strength steel sheet for warm working according to claim 18, the method further comprising performing an alloying treatment after the zinc coating treatment and before the cooling process for annealing.

20. A method for manufacturing the high-strength steel sheet for warm working according to claim 3, the method comprising:

a heating process for annealing in which a hot-rolled steel sheet or a cold-rolled steel sheet is heated at an average heating rate of 10° C/s or more in a temperature range of 300° C. to 500° C., a holding process for annealing in which the heated steel sheet is further heated to a temperature range of greater than 680° C. and less than or equal to 720° C. and held in the temperature range for 1 second to 30 seconds, and a cooling process for annealing in which the held steel sheet is cooled at an average cooling rate of more than 10° C/s in a temperature range from Ms temperature to room temperature.

* * * * *